US012345415B2

(12) United States Patent
Santangeli et al.

(10) Patent No.: US 12,345,415 B2
(45) Date of Patent: Jul. 1, 2025

(54) BURNER SYSTEM

(71) Applicant: ENVIRONMENTAL ENERGY SERVICES, INC., Sandy Hook, CT (US)

(72) Inventors: P. Robert Santangeli, Easton, CT (US); Jay Richardson, Glastonbury, CT (US)

(73) Assignee: ENVIRONMENTAL ENERGY SERVICES, INC., Sandy Hook, CT (US)

( * ) Notice: Subject to any disclaimer, the term of this patent is extended or adjusted under 35 U.S.C. 154(b) by 624 days.

(21) Appl. No.: 17/825,810

(22) Filed: May 26, 2022

(65) Prior Publication Data

US 2022/0381433 A1 Dec. 1, 2022

Related U.S. Application Data

(60) Provisional application No. 63/193,982, filed on May 27, 2021.

(51) Int. Cl.

| | |
|---|---|
| ***F23N 1/02*** | (2006.01) |
| ***F23C 6/00*** | (2006.01) |
| ***F23C 9/00*** | (2006.01) |

(52) U.S. Cl.
CPC ..... *F23N 1/022* (2013.01); *F23C 6/00* (2013.01); *F23C 9/00* (2013.01); *F23C 2900/9901* (2013.01)

(58) Field of Classification Search
CPC ..... F23D 2208/00; F23C 6/00; F23C 9/00; F23N 1/022; F23N 2223/48; F23N 2237/00
See application file for complete search history.

(56) References Cited

U.S. PATENT DOCUMENTS

2021/0372864 A1* 12/2021 Tao ..... G05B 13/042

* cited by examiner

*Primary Examiner* — Ko-Wei Lin
(74) *Attorney, Agent, or Firm* — Dorsey & Whitney LLP

(57) ABSTRACT

A burner system is disclosed. In one example, the burner system includes an artificial intelligence configured to be executed on a processing element. The burner control system may define a control envelope and include a burner, an oxidizer subsystem, and a fuel subsystem. The oxidizer subsystem and the fuel subsystem may include one or more control devices operative to supply an oxidizer and a fuel to the burner to support a combustion process within the burner. The artificial intelligence may be operative to control the burner control system on a trim control curve within the control envelope.

20 Claims, 6 Drawing Sheets

BURNER SYSTEM

CROSS-REFERENCE TO RELATED APPLICATIONS

This application claims the benefit of priority pursuant to 35 U.S.C. § 119(e) of U.S. provisional patent application No. 63/193,982, filed 27 May 2021, entitled "BURNER SYSTEM" which is hereby incorporated by reference herein in its entirety.

BACKGROUND

Fuel burners (or "burners") are used for a variety of applications where potential energy stored in the fuel is converted for a variety of uses. In many applications, fuel is combusted to provide heat for building conditioning, for process application, or for electrical generation. In some applications, energy is transferred to a working fluid (typically water/steam) which is then used for heating or electrical generation application.

As products of combustion, fuel burners produce a variety of compounds including one or more pollutants such as sulfur dioxide, carbon monoxide, carbon dioxide, particulates, volatile organic compounds, hydrogen, and/or oxides of nitrogen ("NOx"), and the like. To reduce emissions, burners utilizing low NOx, or ultra-low NOx technologies have been developed. Such burners have lower NOx emissions than traditional burners, however, their NOx emissions may be affected by many factors such as hardware positions, fuel and air staging and mixing, load swings, and non-optimized or non-ideal operating conditions (e.g. low pressures, high oxygen conditions, etc.). Variations in these factors can result in inefficient operation and increased pollutant emissions (e.g., increased NOx and/or CO emissions). The frequency and extent of these problems typically worsen with increasingly stringent NOx emissions requirements, due to the narrowing operating zones. Problems may arise due to changes in burner output (e.g., rapid changes in the burner firing rate) and/or operating the burner at or near stable combustion limits.

Improved systems and methods to control burners are desired to address these and other issues.

BRIEF SUMMARY

A burner system is disclosed. In one embodiment, the burner system includes an artificial intelligence configured to be executed on a processing element. The burner system includes a burner control system defining a control envelope. The burner control system includes a burner, an oxidizer subsystem, and a fuel subsystem. The oxidizer subsystem and the fuel subsystem include one or more control devices operative to supply an oxidizer and a fuel to the burner to support a combustion process within the burner. The artificial intelligence is operative to control the burner control system on a trim control curve within the control envelope.

Optionally in some embodiments, the artificial intelligence changes the trim control curve responsive to a burner input data.

Optionally in some embodiments, the control envelope is defined by an upper hard bound and a lower hard bound.

Optionally in some embodiments, the control envelope is further defined by an upper soft bound and a lower soft bound defined within the upper hard bound and the lower hard bound.

Optionally in some embodiments, the burner includes more than one burner zone.

Optionally in some embodiments, the more than one burner zone are independently controllable.

Optionally in some embodiments, the fuel is one of a gas, a liquid, or a solid.

Optionally in some embodiments, the gas is one of natural gas or hydrogen.

Optionally in some embodiments, the burner control system includes an exhaust subsystem.

Optionally in some embodiments, the exhaust subsystem is in selective fluid communication with the oxidizer subsystem and operative to recirculate a portion of an exhaust stream to the oxidizer subsystem.

Optionally in some embodiments, the selective fluid communication of the exhaust subsystem and the oxidizer subsystem is controllable by a flow restrictor disposed between the exhaust subsystem and the oxidizer subsystem.

A method of operating a burner system is disclosed. In one embodiment, the method includes receiving, with a processing element, input data of the burner system; receiving, with the processing element, performance data of the burner system; receiving, with the processing element, a setpoint of the burner system; and actuating, with an artificial intelligence executed on the processing element, one or more control devices of a burner control system.

Optionally in some embodiments, the method further includes training the artificial intelligence. The training may include operating, with the processing element, the burner system; tuning, with the processing element, the burner performance; determining, with the processing element, an operating bound of the burner control system; and providing the input data and the performance data to the artificial intelligence to train the artificial intelligence to operate the burner control system.

Optionally in some embodiments, the burner control system defines a control envelope.

Optionally in some embodiments, the artificial intelligence is operative to control the burner control system on a trim control curve within the control envelope.

Optionally in some embodiments, the control envelope is defined by an upper hard bound and a lower hard bound.

Optionally in some embodiments, the control envelope is further defined by an upper soft bound and a lower soft bound defined within the upper hard bound and the lower hard bound.

Optionally in some embodiments, the burner includes more than one burner zone.

Optionally in some embodiments, the more than one burner zone are independently controllable.

Optionally in some embodiments, the burner control system includes: an oxidizer subsystem, and a fuel subsystem. The oxidizer subsystem and the fuel subsystem include the one or more control devices operative to supply an oxidizer and a fuel to the burner to support a combustion process within the burner.

DETAILED DESCRIPTION

Figure 1A:
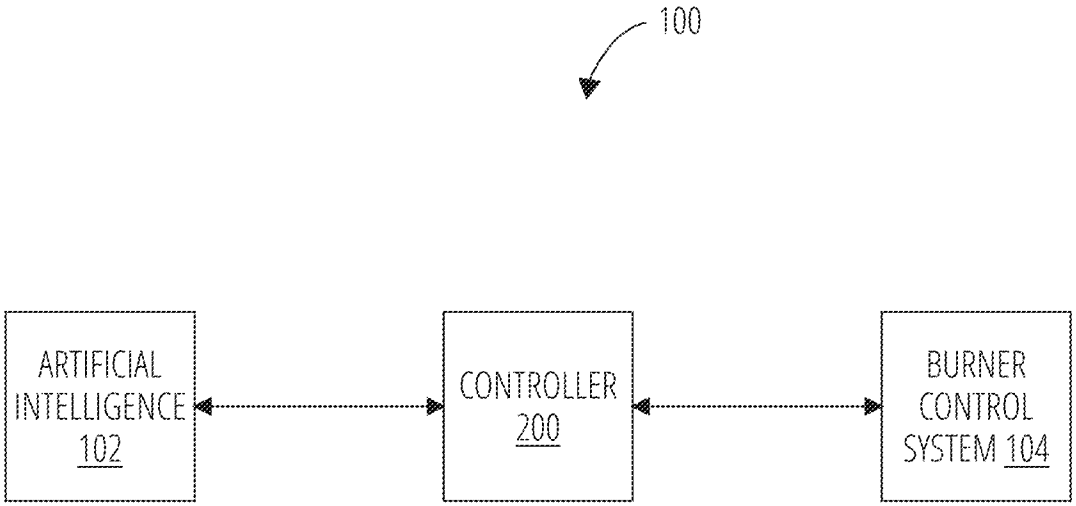
FIG. 1A is a simplified block diagram of a burner system.

Disclosed herein are examples of burner systems and method suitable for controlling a fuel burner, such as an ultra-low or low NOx burner. Burner systems disclosed herein may include a controller suitable to receive inputs from one or more sensors and/or to actuate one or more control devices such as actuators in a burner control system. Burner systems disclosed herein may include an artificial intelligence ("AI") such as an artificial neural net ("ANN") or other suitable method of machine learning.

In many embodiments the disclosed burner system provides efficient operation of the burner with few or no NOx (i.e., NO, $NO_2$) emissions, for example less than about 10 ppm when burning natural gas. Burner systems disclosed herein may include fuel and/or air injection systems, including multi-zone fuel and/or combustion air injection systems. Burner systems may provide control and tuning of fuel and/or air injection systems. Burner systems may include a heat sink that accepts heat from the burner. In one example, the heat sink such as a boiler that absorbs heat from the burner to produce a phase change (e.g., boiling) in a working fluid such as water. Burner systems may include one or more sensors that monitor and produce data related to the environment, fuel, and/or operation of the burner. For example, sensors may monitor, feed, and/or log data related to flue gas composition, ambient environmental conditions, and selected processes (e.g., boiler, furnace, combustor, oxidizer, kiln parameters, etc.) and/or burner parameters such as burner pressure, flame scanner signals, and the like.

The AI includes one or more executable instructions that when executed by a processing element are operative to learn, to solve complex problems, make predictions, or undertake human-like tasks like sensing (such as vision, speech, and touch), perception, cognition, planning, learning, communication, or physical action. The AI may receive and process data from the one or more internal and/or external sources or sensors. In some embodiments, the AI may include an ANN. In some embodiments, the ANN may be trained to recognize burner performance based on sensor data and may optimize burner performance. Optimization of burner performance may include varying or adjusting one or more actuators such as a flow controller, damper, or the like. The AI may model, tune, and/or optimize burner performance, by making or recommending bias adjustments (i.e., changes to an output bounded by one or more limits) to one or more control outputs, such as by adjusting the burner trim control curve. Control outputs may be bound by user-defined adjustment ranges determined during commissioning of the burner system and these outputs may be updated from time to time, for example during periodic manual tuning (e.g., control outputs may be limited by a burner control envelope, described below). The burner system may provide data analytics, system diagnostics, and/or burner optimization such as via the integrated artificial intelligence (AI) module.

In many implementations, the burner system provides machine learning and optimization of prioritized burner performance, which may be defined by one or more criteria, for example, efficiency, emissions, etc. The system may maintain a history or log of optimized biases and may alert the system operator to trend deviations. The system may notify operators of equipment problems, such as drifting sensor calibrations, off-specification fuel, component wear, malfunction, and/or failure, and the like. The AI may use one or more multivariate analysis tools including learning models and/or particle swarm optimization. Such tools may be used to continually monitor and/or tune performance. The AI may enable progressive improvement and/or reprioritization of performance criteria.

FIG. 1A illustrates a burner system 100. The burner system 100 includes an artificial intelligence 102, a controller 200, and a burner control system 104. The burner control system 104 is suitable to operate a burner, such as a low NOx and/or ultra-low NOx burner.

Figure 1B:
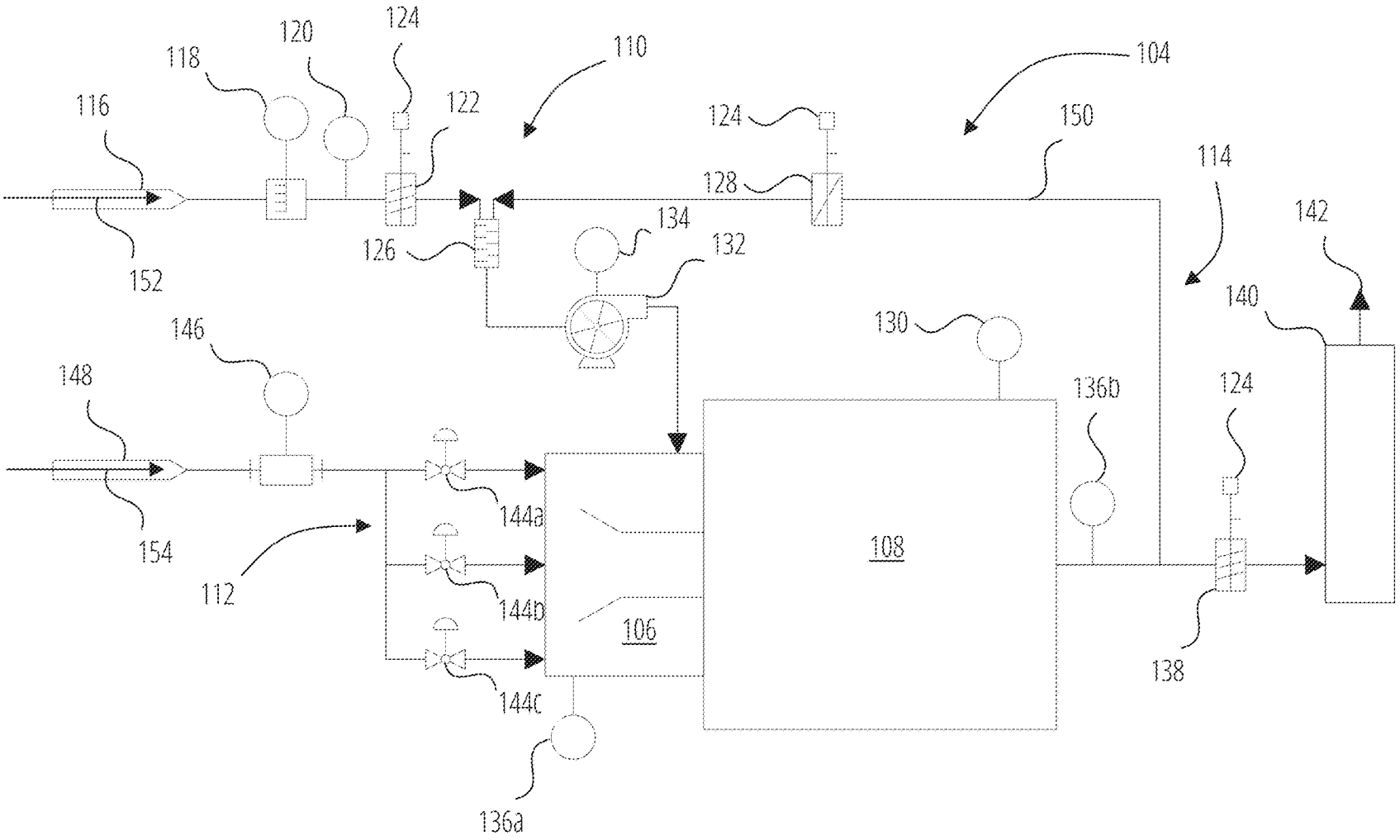
FIG. 1B is a simplified flow diagram of a burner control system suitable for use with the burner system of FIG. 1A.

FIG. 1B is a simplified schematic of an example of a burner control system 104 suitable for use with the burner system 100 of FIG. 1A. The burner control system 104 includes a burner 106 and other suitable control and monitoring equipment as discussed in greater detail below. For example, the burner control system 104 includes an oxidizer subsystem 110, a fuel subsystem 112 and an exhaust subsystem 114 that respectively manage and control the oxidizer 152, fuel 154, and exhaust of the burner 106. The burner 106 combines fuel 154 and an oxidizer 152 such as oxygen or air and burns the fuel 154, generating heat and an exhaust stream 142 (e.g., water, CO2, CO, NOx, and other pollutants). The burner 106 exhausts the exhaust stream 142 to an outlet such as a stack 140. The burner 106 may be operatively coupled to a heat sink 108. The burner control system 104 may include one or more control devices such as a flow restrictor 122, a flow restrictor 128, an actuator 124, a drive 134 and/or one or more flow controls 144*a-c*. The burner control system 104 may include one or more sensors, such as a flow sensor 118, a flow sensor 146, a composition sensor 136*a*, and/or a composition sensor 136*b*.

The oxidizer subsystem 110 includes an inlet 116 into which an oxidizer 152 such as oxygen or a gas containing oxygen (e.g., air) may flow into the oxidizer subsystem 110. The oxidizer subsystem 110 may include an oxidizer mover 132 operative to draw the oxidizer 152 into the oxidizer subsystem 110. The oxidizer mover 132 is in fluidic communication with the inlet 116. One or more conduits may connect the oxidizer mover 132 to the inlet 116. The oxidizer mover 132 may be a fan (e.g., an axial fan), blower (e.g., a centrifugal blower, lobe blower), compressor (e.g., a piston compressor, sliding vane compressor), or the like. The oxidizer mover 132 may be operated by a drive 134. The drive 134 may be any suitable device that causes the oxidizer mover 132 to draw an oxidizer 152 through the oxidizer subsystem 110. In some embodiments the drive 134 is a fixed-speed drive such as a motor. In some embodiments the drive 134 is a variable speed drive such as an engine or a variable frequency drive (VFD). In many implementations, the flow rate of the oxidizer 152, and/or the vacuum at the inlet 116 increases as the rotational speed of the oxidizer mover 132 increases. Thus, as the drive 134 rotates the oxidizer mover 132 faster, relatively more oxidizer 152 may be drawn into the oxidizer subsystem 110 relative to when the oxidizer mover 132 moves at a slower speed.

The oxidizer subsystem 110 may include a flow sensor 118 operative to measure a flow (e.g., mass and/or volume flow) of the oxidizer 152. In some embodiments, the flow sensor 118 may be a sensor such as a Pitot tube, Volu-probe, hot-wire anemometer, orifice, nozzle, Coriolis meter, turbine meter, or the like. In some embodiments, the oxidizer subsystem 110 may include a temperature sensor 120. The 120 may be a thermistor, RTD, thermocouple, infrared meter, or any suitable type of sensor that can measure the temperature of the oxidizer 152 entering the inlet 116.

The oxidizer subsystem 110 may include a flow restrictor 122. In some examples, the flow restrictor 122 may be a valve, damper (e.g., an opposed vane multi-blade adapter, a single blade damper, or the like). The flow restrictor 122 may be adjustable to an open position wherein the oxidizer 152 can flow through the flow restrictor 122 and may be adjustable to a closed position where the flow of the oxidizer 152 through the flow restrictor 122 is blocked. The flow restrictor 122 may be adjustable to many positions between the open and closed positions. In some embodiments the flow restrictor 122 may be continuously adjustable between the open and closed positions (e.g., adjustable to any position between open and closed). In some embodiments the flow restrictor 122 may be discretely adjustable between the open and closed positions (e.g., adjustable to full open, ¾ open, ½ open, ¼ open, fully closed, or the like). As the flow restrictor 122 is adjusted toward the closed position from the open position, the flow rate of the oxidizer 152 through the flow restrictor 122 (and into the oxidizer subsystem 110) may be reduced. In many implementations, the flow restrictor 122 may be operated by an actuator 124. The actuator 124 may be any suitable device that can move the flow restrictor 122 between open and closed positions. In many examples, the actuator 124 may be a motor, gearbox, servo, stepper motor, piston and cylinder (e.g., a pneumatic or hydraulic piston and cylinder), or the like. In some examples, the actuator 124 power the flow restrictor 122 toward the open and closed positions. In some examples, the actuator 124 powers the flow restrictor 122 toward the open or closed position and a biasing element biases the flow restrictor 122 to the other of the open or closed positions such that the biasing element moves the flow restrictor 122 to the biased position in the absence of an input from the actuator 124.

The oxidizer subsystem 110 may be in selective fluidic communication with the exhaust subsystem 114. For example, one or more recirculation conduits 150 may be in fluid communication with the exhaust stream 142 and with the inlet 116. The recirculation conduit 150 may include a flow restrictor 128 operatively coupled to an actuator 124. The recirculation conduit 150 may be the same as, or similar to the flow restrictor 122 previously described, which description is not repeated here for the sake of brevity. The recirculation conduit 150 and the inlet 116 may be in fluidic communication with a chamber 126. The chamber 126 may be a discrete mixing chamber, or a junction between one or more conduits, such as a tee, or the like. The recirculation conduit 150 may be operative to enable the flow of all or a portion of the exhaust stream 142 to the chamber 126. Likewise, the inlet 116 may be operative to direct all or a portion of the oxidizer 152 flow to the chamber 126. The portion of the exhaust stream 142 flowing to the chamber 126 and the oxidizer 152 may mix in the chamber 126. The mixture of oxidizer 152 and portion of the exhaust stream 142 may then flow to the oxidizer mover 132 and then the burner 106. The flow restrictor 128 may be used to selectively change the amount of the exhaust stream 142 that is recirculated to the chamber 126. Recirculating a portion of the exhaust stream 142 may have the benefit of lowering NOx or other emissions from the burner 106. For example, the exhaust gas recirculation (also called flue gas recirculation) can be a highly effective technique for lowering NOx emissions from burners in certain applications, as well as being relatively inexpensive to apply. In some examples, recirculating up to 25% of the exhaust stream 142 through the burner 106 can lower NOx emissions by about 75% or more.

The fuel subsystem 112 provides fuel 154 to the burner 106. Examples of fuels used may include natural gas (e.g., methane optionally mixed with other flammable and/or non-flammable gases), propane, ethane, butane, carbon monoxide, petroleum products (e.g., oil, naptha, diesel, gasoline, etc.), biomass (peat, wood, switch grass, etc.), coal, coke, hydrogen, and/or other suitable fuels. The fuel subsystem 112 may include a fuel inlet 148 that provides fuel 154 from a fuel 154 source such as a tank, vessel, grinder, or storage location to the fuel subsystem 112. The fuel subsystem 112 may include a flow sensor 146. The flow sensor 146 may be similar to the flow sensor 118 as previously described. In embodiments where the fuel is a solid such as coal or coke, the flow sensor 146 may be a weigh scale or other suitable sensor that can measure a flow rate of a solid fuel. In many embodiments, the fuel 154 is a gas such as natural gas. The flow of the fuel 154 into the burner 106 may be controlled by a flow control such as a flow control 144*a*, flow control 144*b*, and/or flow control 144*c*. For example, the burner 106 may have two or more burner zones, where the flow of the fuel 154 to each zone is controlled by one or more flow controls. In some examples, the burner zones are independently controllable, such as by controlling the respective flow controls 144*a-c*. In some examples, such as when the fuel 154 is a gas, the flow control may be a valve such as an on/off valve, an injector, a metering valve, a mass flow controller, or the like.

In some embodiments, the burner 106 may be in operative communication with the composition sensor 136*a*. In many embodiments, the composition sensor 136*a* is an oxidizer 152 sensor that measures the concentration of the oxidizer 152 in the burner 106. For example, the composition sensor 136*a* may be an oxygen sensor operative to measure the oxygen concentration in the burner 106. It may be advantageous to measure the oxygen concentration in the burner 106 to control the emissions, efficiency, heat rate, or other aspect of the burner 106, such as by monitoring the stoichiometry of the combustion process in the burner 106.

As the fuel 154 burns in the burner 106, heat is released. The heat released may be received by a heat sink 108. The heat sink 108 may be any suitable device or process interface that accepts the heat generated by the burner 106. In some examples, a heat sink may be a thermal oxidizer, process gas stream (or hot gas generator) and/or other configurations which do not involve transfer of energy from the burner to a working fluid. In many examples, the heat sink 108 may be a boiler that accepts heat from the burner to cause a phase change in a working fluid such as water or the like. In some examples, the heat sink 108 is in operative communication with a turbine suitable to generate electrical power from the burner heat. In some examples, the heat sink 108 may be a heat exchanger that conveys the heat from the burner 106 to another device, process (e.g., an industrial process), building (e.g., a space heating system such as a heating, ventilation, and air conditioning (HVAC) system, water heater, etc.) or other suitable heat sink. The heat sink 108 may be operatively coupled to a pressure sensor 130 that measures a pressure in the heat sink 108.

As the fuel 154 burns in the burner 106, the oxidizer 152 and fuel 154 are converted chemically into an exhaust stream 142. The exhaust stream 142 may be handled by the exhaust subsystem 114. The exhaust subsystem 114 may include a composition sensor 136*b* in operative communication with the exhaust stream 142 such as to monitor a composition of the exhaust stream. In many examples, the composition sensor 136*b* may be a $CO_2$, CO, $NO_x$, oxygen, and/or other suitable sensor. It may be advantageous to monitor the composition of the exhaust stream 142 to control the emissions, efficiency, heat rate, or other aspect of the burner 106, such as by monitoring the stoichiometry of the combustion process in the burner 106.

The exhaust subsystem 114 may include a flow restrictor 138 operatively coupled to an actuator 124, which may be the same as or similar to the flow restrictor 122. The flow restrictor 138 may be used to control the pressure in the burner control system 104, such as a pressure in the heat sink 108 as may be monitored by the pressure sensor 130. Additionally and/or alternately, the flow restrictor 138 may control an amount of the exhaust stream 142 that is recirculated to the chamber 126 via the recirculation conduit 150. For example, as the flow restrictor 138 is moved to a relatively more closed position, the pressure in the burner 106 and/or amount of the exhaust stream 142 recirculated may be increased relative to a more open position of the flow restrictor 138.

Figure 2:
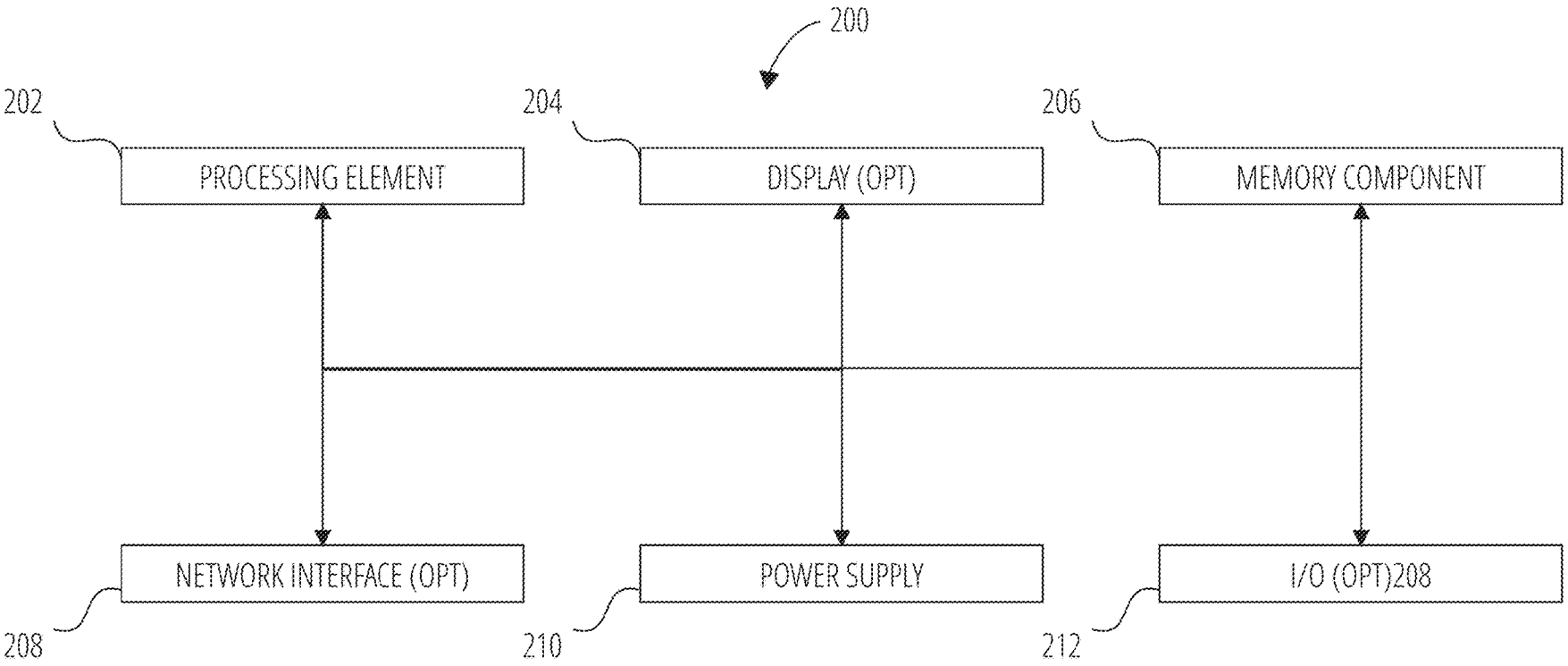
FIG. 2 is a simplified block diagram of a controller suitable for use with the burner system of FIG. 1A.

FIG. 2 illustrates a simplified block diagram for the various devices of the controller 200 and/or a device that hosts or executes the artificial intelligence 102. As shown, the various devices may include one or more processing elements 202, an optional display 204, one or more memory components 206, a network interface 208, optional power supply 210, and an optional input/output (I/O) interface, where the various components may be in direct or indirect communication with one another, such as via one or more system buses, contract traces, wiring, or via wireless mechanisms.

The one or more processing elements 202 may be substantially any electronic device capable of processing, receiving, and/or transmitting instructions. For example, the processing elements 202 may be a microprocessor, microcomputer, graphics processing unit, or the like. It also should be noted that the processing element 202 may include one or more processing elements or modules that may or may not be in communication with one another. For example, a first processing element may control a first set of components of the computing device and a second processing element may control a second set of components of the computing device where the first and second processing elements may or may not be in communication with each other. Relatedly, the processing elements may be configured to execute one or more instructions in parallel locally, and/or across the network, such as through cloud computing resources. In some implementations, the artificial intelligence 102 may be executed by the processing element 202 of the controller 200. In some implementations, the artificial intelligence 102 may be executed by a one or more separate processing elements, such as on a computer, a separate controller from the controller 200, or the like.

The display 204 is optional and provides an input/output mechanism for devices of the system 100, such as to display visual information (e.g., images, graphical user interfaces, videos, notifications, and the like) to a user, and in certain instances may also act to receive user input (e.g., via a touch screen or the like). The display may be an LCD screen, plasma screen, LED screen, an organic LED screen, or the like. The type and number of displays may vary with the type of devices (e.g., smartphone versus a desktop computer).

The memory component 206 stores electronic data that may be utilized by the computing devices, such as audio files, video files, document files, programming instructions, and the like. The memory component 206 may be, for example, non-volatile storage, a magnetic storage medium, optical storage medium, magneto-optical storage medium, read only memory, random access memory, erasable programmable memory, flash memory, or a combination of one or more types of memory components.

The network interface 208 receives and transmits data to and from a network to the various devices of the burner system 100. The network/communication network interface 208 may transmit and send data to a network directly or indirectly. For example, the networking/communication interface may transmit data to and from other computing devices through the network. In some embodiments, the network interface may also include various modules, such as an application program interface (API) that interfaces and translates requests across the network to the device or controller 200. A controller 200 may include communication options with a combustion control or distributed control (CCS/DCS) system via Modbus, or OPC.

The various devices of the system may also include a power supply 210. The power supply 210 provides power to various components of the controller 200. The power supply 210 may include one or more rechargeable, disposable, or hardwire sources, e.g., batteries, power cord, AC/DC inverter, DC/DC converter, or the like. Additionally, the power supply 210 may include one or more types of connectors or components that provide different types of power to the controller 200. In some embodiments, the power supply 210 may include a connector (such as a universal serial bus) that provides power to the computer or batteries within the computer and also transmits data to and from the device to other devices.

The input/output I/O interface 212 allows the system devices to receive input from a user and provide output to a user. In some devices, for instance the controller 200, the I/O interface may be optional. For example, the input/output I/O interface 212 may include a capacitive touch screen, keyboard, mouse, stylus, or the like. The type of devices that interact via the input/output I/O interface 212 may be varied as desired.

Figure 3:
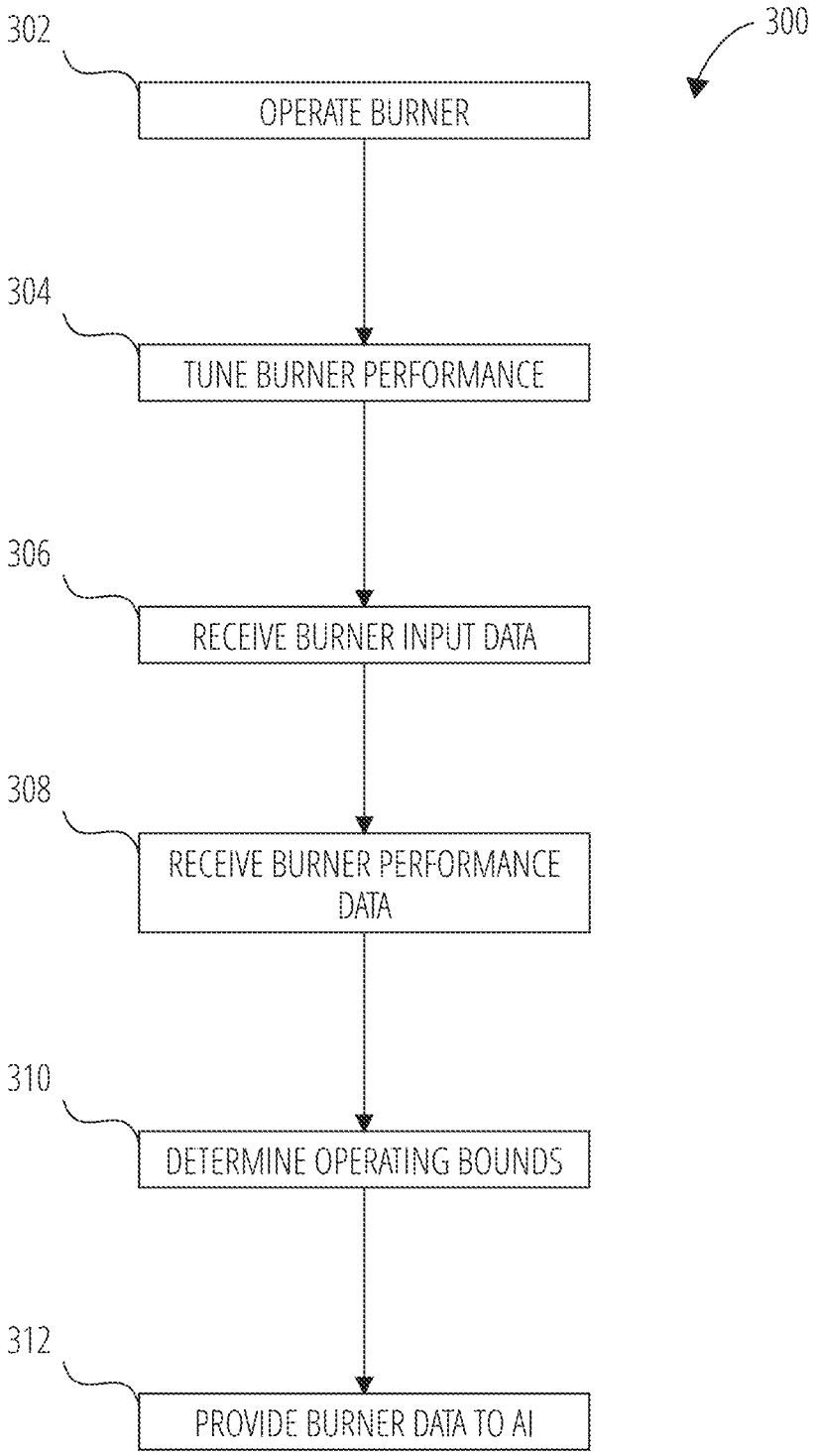
FIG. 3 is a flowchart of a method of training an artificial intelligence of FIG. 1A.

FIG. 3 illustrates a method of training the artificial intelligence 102. The method 300 may begin in operation 302 and the burner 106 is operated. For example, an oxidizer 152 and a fuel 154 may be supplied to the burner 106. The flow restrictor 122 may be at least partially opened and the oxidizer mover 132 may be driven by the drive 134. Similarly, the fuel 154 may flow to the burner 106 via the one or more flow controls such as the flow control 144*a-c*. The oxidizer 152 may react with the fuel 154 in a combustion reaction in the burner 106. The oxidizer 152 and the fuel 154 may be converted through the combustion reaction to the exhaust stream 142.

The method 300 may proceed to operation 304 and the burner control system 104 performance is tuned. For example, the heat rate of the burner 106 may be changed to one or more levels between a minimum heat rate and a maximum heat rate. The heat rate of the burner may be a measure of the heat energy of the fuel 154 supplied to the burner 106 as a function of time, such as a measurement of power like BTU/hr, kW, MW, or the like. In some embodiments, the heat rate of the burner 106 is the amount of heat energy from fuel that will produce a kilowatt-hour of electricity. The positions of one or more of the flow restrictor 122, oxidizer mover 132, the flow restrictor 128, the actuator 124, and/or the flow controls 144*a-c* may be changed to achieve a desired heat rate, efficiency, emissions level (e.g. $NO_x$), fuel consumption, or oxidizer consumption. In some embodiments, the burner control system 104 may be gradually turned between low and high heat rate. In some embodiments the burner control system 104 may be subject to one or more step changes in heat rate over a short period of time.

The method 300 may proceed to operation 306 and data related to the inputs to the burner control system 104 are received. For example, one or more of the sensors of the burner control system 104 may be monitored and data related to the inputs (e.g., oxidizer 152 and/or fuel 154 properties) as the burner control system 104 is operated. For example, the outputs of the flow sensor 118, the flow sensor 146, and/or the composition sensor 136*a* may be received by the controller 200, the artificial intelligence 102, or other suitable device or system. In some examples, ambient and/or inlet conditions (e.g., the humidity, pressure and/or temperature of the oxidizer 152 and/or fuel 154, and/or fuel composition) may be monitored by one or more sensors of the burner control system 104.

The method 300 may proceed to operation 308 and data related to the outputs, status, and/or performance of the burner control system 104 are received. For example, one or more sensors of the burner control system 104 and/or actuators may be monitored as the burner control system 104 is operated. Parameters and/or data associated with the status of the burner control system 104 may be monitored, for example boiler parameters such as steam flow, burner 106 pressure, flame scanner signals, flue gas composition (e.g., $NO_x$, $O_2$, $CH_4$), and the like. For example, the outputs of the pressure sensor 130, the composition sensor 136*b*, the actuators 124, the drive 134, and/or the flow controls 144*a-c* may be received by the controller 200, the artificial intelligence 102, or other suitable device or system.

Figure 5:
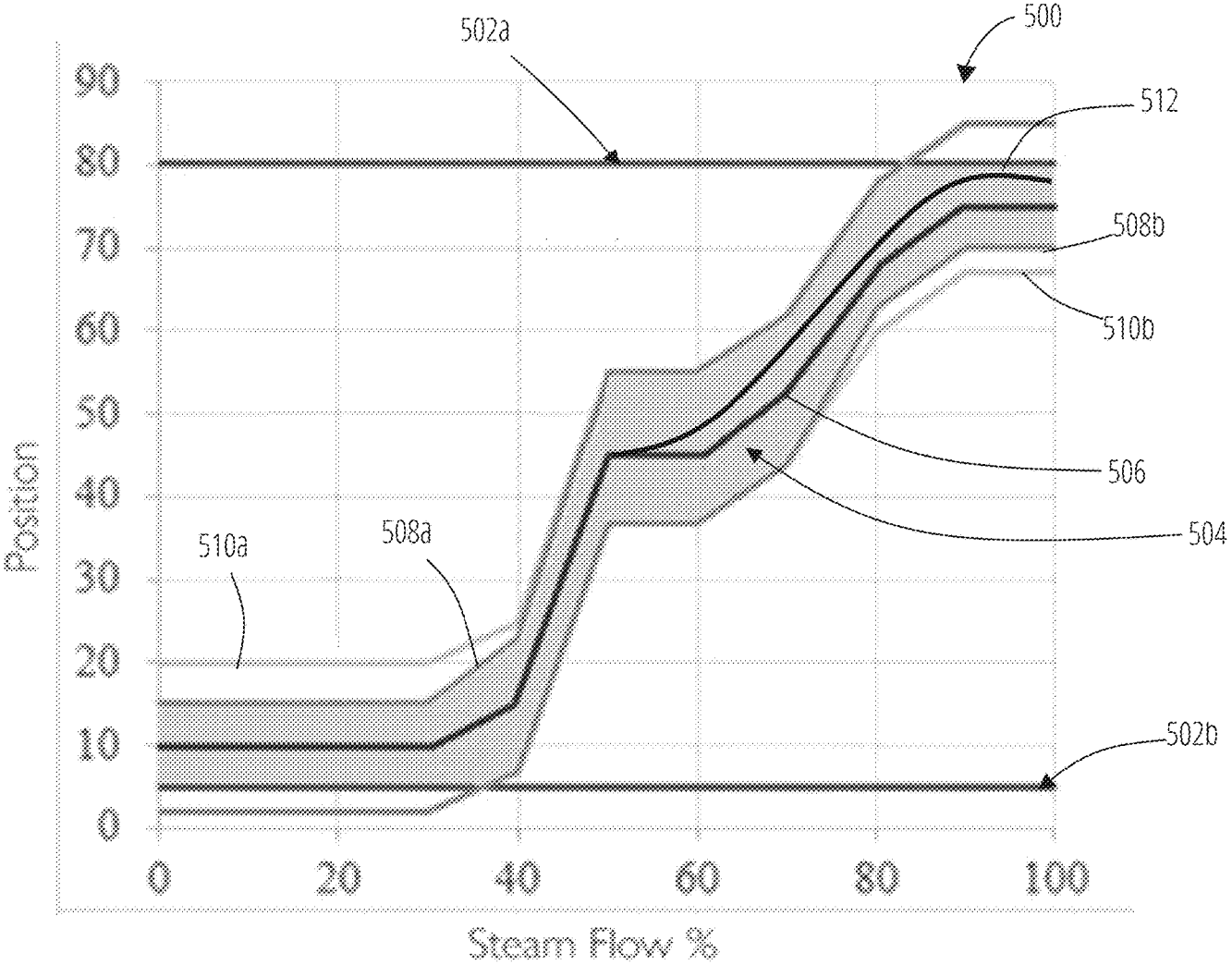
FIG. 5 illustrates an example of a control envelope of the burner of FIG. 1B.

The method 300 may proceed to operation 310 and one or more operating bounds of the burner control system 104 are determined. For example, a maximum heat rate of the burner control system 104, a minimum heat rate of the burner control system 104, the turndown ratio (e.g., a ratio of the maximum heat rate to minimum heat rate) of the burner control system 104, and/or a slew rate of the burner control system 104 (e.g., a rate of change in the heat rate), may be determined. FIG. 5 shows an example of operating bounds as may be determined in the operation 310.

The method 300 may proceed to operation 312 and the data received in operation 306, operation 308, and/or operation 310 may be provided as training data to the artificial intelligence 102. The training data may be used as examples to adjust the weights of connections between neurons in an artificial intelligence 102 such as an artificial neural network, thereby training the artificial intelligence 102 how to operate the burner control system 104. Operation 312 may also include providing data from one or more of operation 306, operation 308, and/or operation 310 as validation data and/or testing data such as to confirm the ability of the artificial intelligence 102 to operate the burner control system 104

Figure 4:
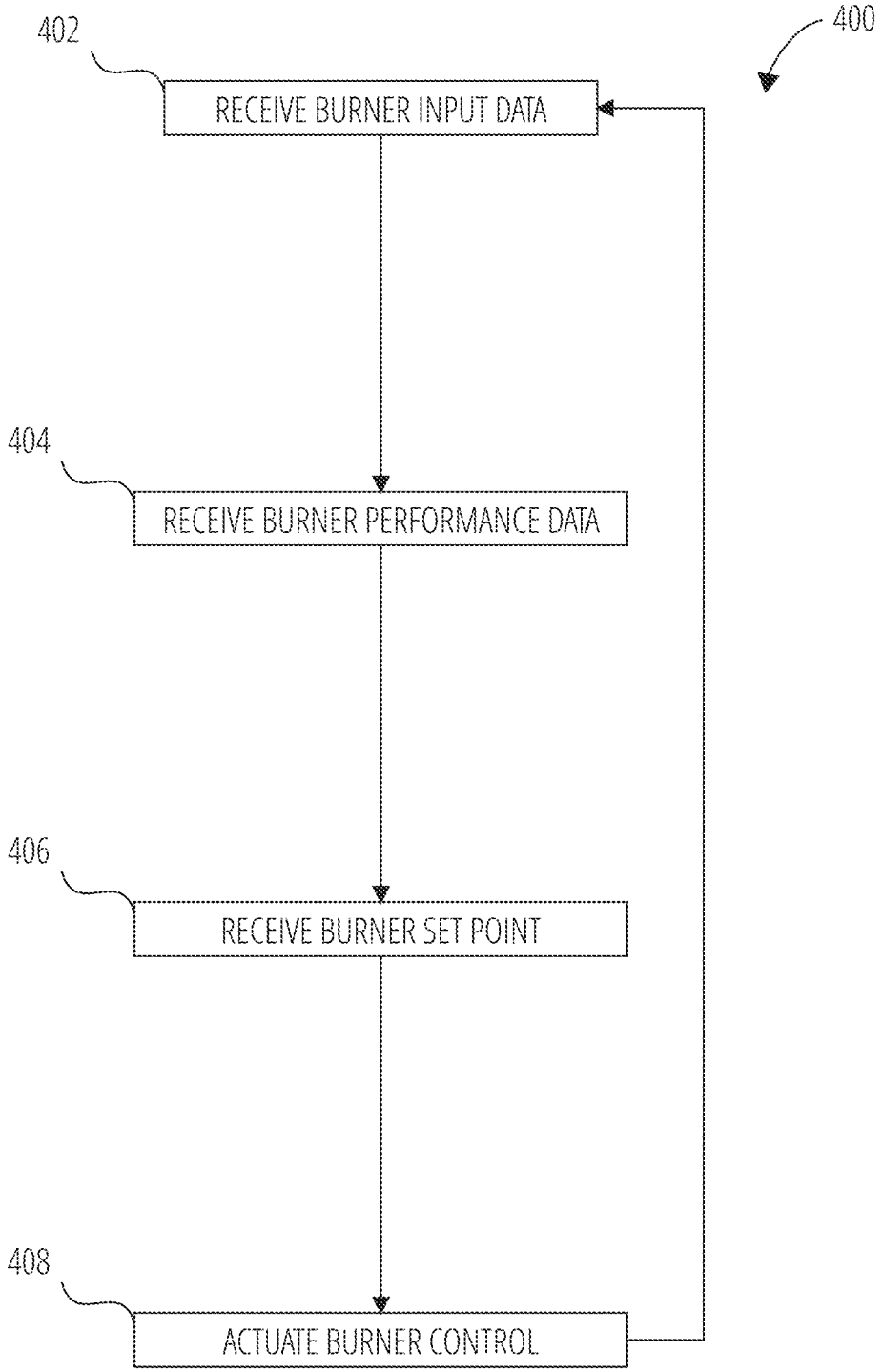
FIG. 4 is a flowchart of a method of controlling the burner of FIG. 1B.

FIG. 4 is a method 400 of operating the burner control system 104 using an artificial intelligence 102. The method 400 may begin in operation 402 and the controller 200 and/or artificial intelligence 102 receives input data to the burner control system 104. For example, inputs may be received as previously described with respect to the operation 306, which description is not repeated here for the sake of brevity.

The method 400 may proceed to the operation 404 and outputs, status, and/or performance of the burner control system 104 are received. The operation 404 may be similar to the operation 308 previously described, which description is not repeated here for the sake of brevity.

The method 400 may proceed to the operation 406 and a setpoint of the burner system 100 is received. A setpoint may include a desired heat rate of the burner system 100. For example, if the burner control system 104 includes a heat sink 108 such as a boiler operatively coupled to a turbine to generate power, the heat rate may be determined based on a demand for electrical power. In another example, if the heat sink 108 is operatively coupled to an HVAC system, the setpoint may be determined by a demand for heat from the HVAC system. In some examples, the setpoint may be steady, while in other examples, the setpoint may vary over time. The setpoint may be received by the artificial intelligence 102, the controller 200, or other suitable device or system.

The method 400 may proceed to operation 408 and one or more actuators of the burner control system 104 are actuated, such as to achieve the setpoint determined in the operation 406. For example, the artificial intelligence 102 may analyze the data received in the operation 402, the operation 404, and/or the setpoint received in the operation 406. The data received may form a pattern that the artificial intelligence 102 may match based on the weights between neurons. The artificial intelligence 102 may determine one or more output actions based on the pattern. The artificial intelligence 102 may pass output actions to the controller 200. The controller 200 may operate one or more actuators, valves, drives, dampers, flow controls, or the like. For example, the controller 200 may change a position or setting of the flow restrictor 122, the flow restrictor 128, the flow restrictor 138, one or more of the flow controls 144*a-c*, and/or the drive 134, based on a command from the artificial intelligence 102.

The method 400 may return to the operation 402 such that the method 400 operates in a loop. The method 300 and or the method 400 may be executed in an order other than as shown. In some implementations, two or more operations may be executed substantially in parallel with one another. In some implementations, operations of the method 300 and/or method 400 may be executed by different processing elements.

FIG. 5 shows an example performance map 500 of a burner control system 104 suitable for control by an artificial intelligence 102. The horizontal axis (x-axis) shows an example of an independent variable such as a performance parameter of the burner control system 104. The vertical axis (y-axis) of the performance map 500 shows an example of a dependent variable such as a position of a control device of the burner control system 104 such as a flow restrictor 122, a flow restrictor 128, as flow restrictor 138, a drive 134, and/or one or more flow controls 144*a-c*. The dependent variable may be a result of the independent variable. In the example shown, the performance parameter is steam flow in a heat sink 108. Other suitable parameters may be used, such as heat rate, efficiency, power output, or the like.

The performance map 500 includes a control curve 506. The control curve 506 defines a nominal relationship between the independent variable (e.g., the x-axis variable) and the dependent variable (e.g., the y-axis variable). For example, as shown in FIG. 5, the position of a control device may be affected by the requested or actual steam flow of the heat sink 108, or other similar parameter. The performance map 500 may be bounded by an upper hardware bound 502*a* and/or a lower hardware bound 502*b* that define limits of hardware performance.

A control envelope 504 may be defined about the control curve 506. For example, the relationship between the independent variable and the dependent variable may be defined in a region of the performance map 500 above, on, and/or below the control curve 506. The control envelope 504 may be defined by one or more bounds. For example, the control envelope 504 may have a control envelope upper soft bound 508*a* and/or a control envelope lower soft bound 508*b* spaced about the control curve 506. The soft bounds may define the control envelope 504 where the burner control system 104 can operate while being constrained by one or more operational requirements such as emissions level, efficiency, or the like. The control envelope 504 may also have a control envelope upper hard bound 510*a* and/or a control envelope lower hard bound 510*b*. The hard bounds may define the control envelope 504 where the burner control system 104 can operate while being constrained by one or more physical constraints of the burner control system 104 such as maximum or minimum flow rates, flame stability, turndown ratios, or the like.

FIG. 5 shows an example of the artificial intelligence 102 operating the burner control system 104. The artificial intelligence 102 may trim the independent variable such that the dependent variable remains within the control envelope 504. For example, the artificial intelligence 102 may trim the independent variable such rather than the burner control system 104 being controlled on the control curve 506, the burner control system 104 may be controlled on a trim control curve 512. The trim control curve 512 may deviate from the control curve 506 while remaining within the bounds (e.g., hard or soft bounds) of the control envelope 504. The benefits of operating the burner control system 104 as described may include continual and or automatic adaptation of the burner control system 104 to changing inputs or environment while maintaining operational requirements such as emissions levels, efficiency, heat rate, or the like. In one example, as the humidity of the oxidizer 152 changes (e.g., because of changes in weather), a burner without a burner control system 104 may flame out when operating at a low heat rate. In contrast, the artificial intelligence 102 of the burner system 100 may detect the change in humidity of the oxidizer 152 and adjust fuel 154 and/or oxidizer 152 flowrates to maintain the flame in the burner 106. In another example, as the burner control system 104 is subjected to a large step change in heat rate, the flame may become unstable. The artificial intelligence 102 may operate the burner control system 104 on a trim control curve 512 to stabilize the flame while meeting the demand of the step change in heat rate.

The description of certain embodiments included herein is merely exemplary in nature and is in no way intended to limit the scope of the disclosure or its applications or uses. In the included detailed description of embodiments of the present systems and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Of course, it is to be appreciated that any one of the examples, embodiments or processes described herein may be combined with one or more other examples, embodiments and/or processes or be separated and/or performed amongst separate devices or device portions in accordance with the present systems, devices and methods.

Finally, the above discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

What is claimed is:

1. A burner system comprising:

an artificial intelligence executed on a processing element;

a burner control system defining a control envelope and including:

a burner, an oxidizer subsystem, and a fuel subsystem:

wherein the oxidizer subsystem and the fuel subsystem include one or more control devices operative to supply an oxidizer and a fuel to the burner to support a combustion process within the burner, and wherein the artificial intelligence is operative to control the burner control system on a trim control curve within the control envelope.

2. The burner system of claim 1, wherein the artificial intelligence changes the trim control curve responsive to a burner input data.

3. The burner system of claim 1, wherein the control envelope is defined by an upper hard bound and a lower hard bound.

4. The burner system of claim 3, wherein the control envelope is further defined by an upper soft bound and a lower soft bound defined within the upper hard bound and the lower hard bound.

5. The burner system of claim 1, wherein the burner includes more than one burner zone.

6. The burner system of claim 5, wherein the more than one burner zone are independently controllable.

7. The burner system of claim 1, wherein the fuel is one of a gas, a liquid, or a solid.

8. The burner system of claim 7, wherein the gas is one of natural gas or hydrogen.

9. The burner system of claim 1, wherein the burner control system includes an exhaust subsystem.

10. The burner system of claim 9, wherein the exhaust subsystem is in selective fluid communication with the oxidizer subsystem and operative to recirculate a portion of an exhaust stream to the oxidizer subsystem.

11. The burner system of claim 10, wherein the selective fluid communication of the exhaust subsystem and the oxidizer subsystem is controllable by a flow restrictor disposed between the exhaust subsystem and the oxidizer subsystem.

12. A method of operating a burner system comprising:

receiving, with a processing element, input data of the burner system;

receiving, with the processing element, performance data of the burner system;

receiving, with the processing element, a setpoint of the burner system; and actuating, with an artificial intelligence executed on the processing element, one or more control devices of a burner control system.

13. The method of claim 12, further comprising training the artificial intelligence including:

operating, with the processing element, the burner system;

tuning, with the processing element, the burner performance;

determining, with the processing element, an operating bound of the burner control system; and providing the input data and the performance data to the artificial intelligence to train the artificial intelligence to operate the burner control system.

14. The method of claim 12, wherein the burner control system defines a control envelope.

15. The method of claim 14, wherein the artificial intelligence is operative to control the burner control system on a trim control curve within the control envelope.

16. The method of claim 14, wherein the control envelope is defined by an upper hard bound and a lower hard bound.

17. The method of claim 16, wherein the control envelope is further defined by an upper soft bound and a lower soft bound defined within the upper hard bound and the lower hard bound.

18. The method of claim 12, wherein the burner includes more than one burner zone.

19. The method of claim 18, wherein the more than one burner zone are independently controllable.

20. The method of claim 12, wherein the burner control system includes:

an oxidizer subsystem, and a fuel subsystem:

wherein the oxidizer subsystem and the fuel subsystem include the one or more control devices operative to supply an oxidizer and a fuel to the burner to support a combustion process within the burner.

* * * * *